US010364120B2

(12) United States Patent
Vergentini

(10) Patent No.: US 10,364,120 B2
(45) Date of Patent: Jul. 30, 2019

(54) WINDING MACHINE FOR SPOOLS OF WEB MATERIAL AND METHOD

(71) Applicant: A.CELLI NONWOVENS S.P.A., Porcari (LU) (IT)

(72) Inventor: Francesco Vergentini, Pieve a Nievole (IT)

(73) Assignee: A.CELLI NONWOVENS S.P.A., Porcari (LU) (IT)

( * ) Notice: Subject to any disclaimer, the term of this patent is extended or adjusted under 35 U.S.C. 154(b) by 195 days.

(21) Appl. No.: 15/591,251

(22) Filed: May 10, 2017

(65) Prior Publication Data

US 2017/0327335 A1 Nov. 16, 2017

(30) Foreign Application Priority Data

May 11, 2016 (IT) ..... 102016000048291

(51) Int. Cl.
*B65H 35/02* (2006.01)
*B65H 23/195* (2006.01)

(52) U.S. Cl.
CPC ..... *B65H 35/02* (2013.01); *B65H 23/195* (2013.01); *B65H 2301/4148* (2013.01); *B65H 2301/414321* (2013.01); *B65H 2511/142* (2013.01); *B65H 2513/11* (2013.01)

(58) Field of Classification Search
CPC ..... B65H 23/195; B65H 35/02; B65H 2301/414321; B65H 2301/4148; B65H 2511/142; B65H 2513/11
See application file for complete search history.

(56) References Cited

U.S. PATENT DOCUMENTS 4,413,792 A 11/1983 O'Connor
2013/0284847 A1 10/2013 Hou

FOREIGN PATENT DOCUMENTS

EP 2 749 513 A1 7/2014
GB 259 632 A 10/1926
WO 2008/096034 A1 8/2008
WO 2010/018305 A1 2/2010

*Primary Examiner* — William E Dondero
(74) *Attorney, Agent, or Firm* — McGlew and Tuttle, P.C.

(57) ABSTRACT

The machine comprises an unwinding section (3) for unwinding parent reels (Ba, Bb) of web material (Na, Nb), and at least one unwinding station (15). A winding device (41, 53) is arranged in the unwinding station, and a longitudinal strip (S) of web material is fed to it and a respective spool (B) of web material is formed in it. A control unit (70) is also provided, configured to control the winding speed of the longitudinal strip (S) in the winding station (15), so as to perform an acceleration cycle to accelerate the winding of the longitudinal strip (S), comprising at least one step of gradually increasing the feeding speed (Vp) of the longitudinal strip (S), wherein the feeding speed is linked to the diameter of the spool (B).

18 Claims, 7 Drawing Sheets

15

61
S
61
23
19
101
93
63
29
35
37
23
39
31
25
31A
B
17
39A
A-A
41
45
55
41B
21
45
49

WINDING MACHINE FOR SPOOLS OF WEB MATERIAL AND METHOD

TECHNICAL FIELD

The invention relates to machines for the production of spools of web material, for example non-woven fabric.

Embodiments described here relate, in particular, to improvements to the systems for controlling the web material acceleration cycles during the winding start phase.

BACKGROUND ART

In many industrial sectors it is necessary to transform reels of web material of one size into spools of a different size, by means of a process of unwinding parent reels, or so-called jumbo reels, and rewinding them into spools with different size characteristics. In certain cases the web material from a single parent reel is unwound and divided into longitudinal strips, each of which is wound onto a helically wound spool. The finished spools obtained in this way are used as semi-finished products to feed production lines for other articles.

Machines that produce spools of helically wound web material from parent reels are sometimes called spooling machines. The web material can, for example, be a non-woven fabric. The helically wound spools that are obtained are used, for example, to feed machines for the production of sanitary towels, diapers and other hygienic and sanitary articles. The web material wound on the parent reels sometimes has a transversal size (corresponding to the axial dimension of the parent reel) 5-15 times the width of the individual longitudinal strips that are obtained by longitudinal cutting of the web material on the parent reels. The individual strips are fed simultaneously to helical winding stations, in each of which a helically wound spool is formed. The winding stations are arranged in line one after the other in a machine direction, defined by the direction of advance of the longitudinal strips obtained by cutting the material on the parent reels. Each strip is fed to the respective winding station along a feed path.

As the web material in a single parent reel is subdivided into a plurality of strips, and as these are helically wound onto the helically wound spools, on which a large quantity of cut material can thus accumulate, the helically wound spool production cycle requires the use of a plurality of parent reels. In other words, if the web material from the parent reels is subdivided into N longitudinal strips, for simultaneous formation of N helically wound spools, in order to form the N helically wound spools a certain number M of parent reels will be required, where M is usually higher than 1, typically between 2 and 10, for example between 2 and 8, in certain cases between 2 and 6.

When a first parent reels finishes, it must be replaced by a second parent reel, and the trailing edge of the first web material coming from the first parent reel must be spliced to the leading edge of the second web material wound on the second parent reel. The splicing phase takes place with the machine stopped, i.e. after having stopped all the rotating members, in particular the helical winding mandrels. The machine is also stopped when the helically wound spools have been completed and must be unloaded from the respective winding mandrels, to be replaced with empty winding cores, upon which a new series of helically wound spools is formed.

As winding of the longitudinal strips takes place in helical turns, the winding mandrels are provided with a rotation movement and a reciprocating translation movement parallel to the rotation axis of the winding mandrel. The feeding speed of the longitudinal strips must be as high as possible to increase the productivity of the machine, but it must take into account the fact that the winding mandrels are subjected to accelerations every time the reciprocating translation movement is reversed. Above all during the initial phase of winding the helically wound spools, when the diameter of the latter is very small, it is not possible to use the maximum feeding speed of the longitudinal strips. This, in fact, would involve reversing the reciprocating translation movement of the helical winding mandrels too frequently, and consequently accelerations and dynamic stress that are too high.

Consequently, at least during the initial phase of winding the helically wound spools, the feeding speed of the individual longitudinal strips, i.e. the linear speed at which the longitudinal strips advance along the individual feed paths, must be kept below the maximum speed achievable by the machine, with a consequent reduction in productivity.

In order to manage the acceleration phase of the feeding movement of the longitudinal strips, empirical expedients are currently used, which are frequently left to the initiative and skill of the technician in charge of the machine. Acceleration is normally carried out in steps, setting a sequential feeding speed, i.e. a linear speed of advance of the longitudinal strips that is kept constant for an interval of time, in order to increase the diameter of the helically wound spools. After a certain interval, considered sufficient to obtain a given increase in the diameter of the spools being formed on the helical winding mandrels, the feeding speed is increased to a higher value, which is then kept constant for a further interval of time, and so on, until reaching the maximum linear feeding speed allowed by the machine, which is maintained until the helically wound spools are completed, or until the parent reel is finished. This manner of proceeding is not ideal from the point of view of making full use of the machine production capacity. Furthermore, it requires an adjustment operation by the operator, who must set the speed steps based on a plurality of production parameters, including for example the thickness of the web material, the width of the strip, the angle of inclination of the helical winding and other values.

Similar problems may also occur when winding non helical spools, i.e. when turns of web material are wound spirally rather than helically. In this case winding takes place only with a rotation movement of the spool, without the reciprocating translation movement. During the initial phase of the winding, when the spool only has a few turns, its diameter is very small. An excessively high feeding speed of the web material or of the strip to be wound causes an excessive angular speed that may induce vibrations in the spool, for example due to the not perfectly cylindrical shape of the spool and/or to imbalance in the mass of the spool itself. Thus, even when there is no reciprocating straight movement component, as in the case of helical winding, there may be problems with excessive dynamic stress if the feeding speed increases too quickly during the winding start phase. Problems with vibrations deriving from excessive angular speed are also seen in helical winding machines and are added to those caused by accelerations in the reciprocating translation movement.

There is therefore a need to optimize the starting cycle for winding of a web material, for example in the form of longitudinal strips, onto a spool, in order to optimize the use of the machine and maximize its production.

SUMMARY

According to one aspect, in order to alleviate or solve one or more of the problems of the prior art, a machine is provided for the formation of spools of web material, for example but not limited to the production of spools of non-woven fabric, comprising an unwinding section for unwinding parent reels of web material and at least one winding station, in which the spools are formed. The winding station comprises a winding device that causes the spool to rotate around a rotation axis. The machine may advantageously also comprise a control unit, to control the winding speed of the spools in the winding station, which is configured to perform a winding acceleration cycle comprising at least one gradual increase in the feeding speed of the web material, in which the feeding speed is related to the diameter of the spool being formed in the winding station, i.e. it may be a direct or indirect function of said diameter.

In the following, specific reference will be made to spooling machines, i.e. helical winding machines, where the spools being formed have a rotation movement and a reciprocating translation movement. In these machines the problems deriving from the excessive feeding speed during the starting phase are more significant, due to the dynamic stress caused by decelerations and accelerations when reciprocating movement is reversed. However, certain advantages obtained with the devices and methods described herein may also be useful in the formation of cylindrically wound spools, i.e. spools wound in overlapping turns, rather than helical ones.

However, in currently preferred embodiments, the machine for the formation of web material spools is a helical winding machine, i.e. a so-called spooling machine, in which the winding device comprises a winding mandrel that, as well as having a rotation movement around the winding axis, i.e. the axis of the mandrel, also has a reciprocating translation movement in a direction parallel to the axis of rotation, to helically wind the web material, i.e. a longitudinal strip, onto the spool, forming a helically wound spool.

In some embodiments, the machine may comprise a cutting station, comprising cutting members to divide the web material coming from the unwinding section into longitudinal strips. In embodiments described herein, the machine may also comprise at least one further winding station, or a plurality of winding stations, arranged in sequence, each of which receives one of the longitudinal strips obtained from cutting of the web material coming from the unwinding section. Each winding station may comprise a respective spiral winding device, or a helical winding device, i.e. a device that only imparts one movement, or a rotation movement combined with a reciprocating translation movement to the spool being formed. For each longitudinal strip, a respective feeding path from the cutting station to the respective winding station may be provided;

The phase of gradually increasing the longitudinal strip feeding speed as a function of the diameter of at least one of the spools being formed allows on the one hand an optimum speed progression, and on the other hand does not require the intervention of the operator, as the function that correlates the feeding speed to the diameter can be fixed for any type of product.

In some embodiments the relation between the feeding speed of the strips and the diameter can be defined by a constant angular speed of the spool being formed.

In certain embodiments, the unwinding section can comprise a first unwinding station and a second unwinding station, to allow a second standing-by parent reel to be prepared while a first parent reel is being unwound. This allows a reduction in machine stoppage time when the parent reels have to be changed. A welding station may also be provided, comprising a welder for welding to each other a first web material, coming from a first parent reel arranged in the first unwinding station, and a second web material, coming from a second parent reel arranged in the second unwinding station.

The control unit can be configured in such a way that the acceleration cycle comprises a preliminary step, preceding the gradual increase in feeding speed, in which the winding is controlled by increasing the angular speed of the spool being formed from zero to a preset angular speed, which may then, for example, be kept constant during the next step.

The control unit may furthermore be configured in such a way that in steady state conditions, the feeding speed, i.e. the linear speed of advance of the longitudinal strip to be wound, is a substantially constant speed.

In some embodiments, when the machine comprises several winding stations in sequence, the spools that are formed in the various winding stations may be formed in such a way that their diameter increases in the same manner. As the longitudinal strips are all fed at the same linear feeding speed, in this case control of the speed according to the diameter can be obtained by reading the diameter of any one of the spools being formed in the various winding stations.

Moreover, in general there may be situations in which the diameter of the various spools increases differently from one spool to another, in spite of the fact that the individual longitudinal strips are fed at the same linear feeding speed. This may occur, for example, in helical winding machines, if winding angles, that is to say the angles of the helically wound turns, are different from spool to spool in the various winding stations. In this case, control of the linear feeding speed of the strips of web material during the acceleration step can be carried out by selecting one of the spools being formed as a reference. For example, the spool whose diameter increases the slowest can be chosen. In the case of different winding angles, this may be the spool on which the helical turns with the greatest inclination are formed. Selection of the reference spool may be carried out manually. In certain embodiments it is possible to provide for the selection to be performed automatically. This can be done, for example, by using suitable sensor members to read the diameter of all the spools being formed, and selecting the one with the smallest diameter as a reference to control the speed during the acceleration step. Likewise in the case of spiral winding, instead of helical winding, there may be differences between spools that are being wound simultaneously in different winding stations, for example if different winding densities are used in the various winding stations. The spools with the highest winding density grow in diameter more slowly than the spools with a lower winding density.

The diameter of the spool or spools can be detected using an encoder that determines the position of a member that rests on the outer cylindrical surface of the spool being formed in the winding station. For example, for that purpose an arm can be provided, hinged around a pivoting axis and provided with a follower, for example a contact roller, that rests on the outer surface of the spool. In other embodiments the diameter can be detected based on the linear feeding speed of the winding strips and the angular speed of the spool being formed. In still further embodiments the diameter can be detected by means of contactless sensor members, for example optical or capacitive emitters and receivers.

According to another aspect, a method is described for winding longitudinal strips of web material onto spools being formed in a winding station, comprising the following steps:

feeding the longitudinal strip to a winding station containing a winding device that causes a spool being formed to rotate around a rotation axis;

starting rotation of the spool being formed;

performing an acceleration of the spool being formed, in which the feeding speed of the longitudinal strip is gradually increased as a function of the diameter of the spool being formed.

In some embodiments the method comprises the step of feeding a plurality of longitudinal strips in parallel to a plurality of winding stations to wind a plurality of spools simultaneously in parallel.

In some embodiments, the spool or spools being formed may be helically wound spools. In this case, the winding device in the winding station or stations is configured to produce a rotation movement of the spool around the winding axis and a reciprocating translation movement in a direction parallel to the winding axis.

Further advantageous features and embodiments of the method and machine according to the invention are described in the following with reference to the attached drawings and in the claims, which form an integral part of this description.

BRIEF DESCRIPTION OF THE DRAWINGS

The invention will be better understood by following the description and the enclosed drawing, which shows a practical and non-limiting form of embodiment of the invention. More specifically, in the drawing.

DETAILED DESCRIPTION OF EMBODIMENTS

The following detailed description of the exemplary embodiments refers to the accompanying drawings. The same reference numbers in different drawings identify the same or similar elements. Additionally, the drawings are not necessarily drawn to scale. Also, the following detailed description does not limit the invention. Instead, the scope of the invention is defined by the appended claims.

Reference throughout the specification to "one embodiment" or "an embodiment" or "some embodiments" means that the particular feature, structure or characteristic described in connection with an embodiment is included in at least one embodiment of the subject matter disclosed. Thus, the appearance of the phrase "in one embodiment" or "in an embodiment" or "in some embodiments" in various places throughout the specification is not necessarily referring to the same embodiment(s). Further, the particular features, structures or characteristics may be combined in any suitable manner in one or more embodiments.

In the following, specific reference is made to a spooling machine, i.e. to a helical winding machine, in which a web material is divided into a plurality of longitudinal strips, which are fed in parallel to a plurality of winding stations. In each winding station the winding devices are configured to form helically wound spools, giving the spool being formed a rotation movement around a rotation axis, and a reciprocating translation movement in a direction parallel to the axis of rotation. In other embodiments, not shown, a single winding station may be provided, if necessary with helical winding. In other embodiments, one or more winding stations may be provided for spiral winding, i.e. without the reciprocating translation movement.

Figure 1:
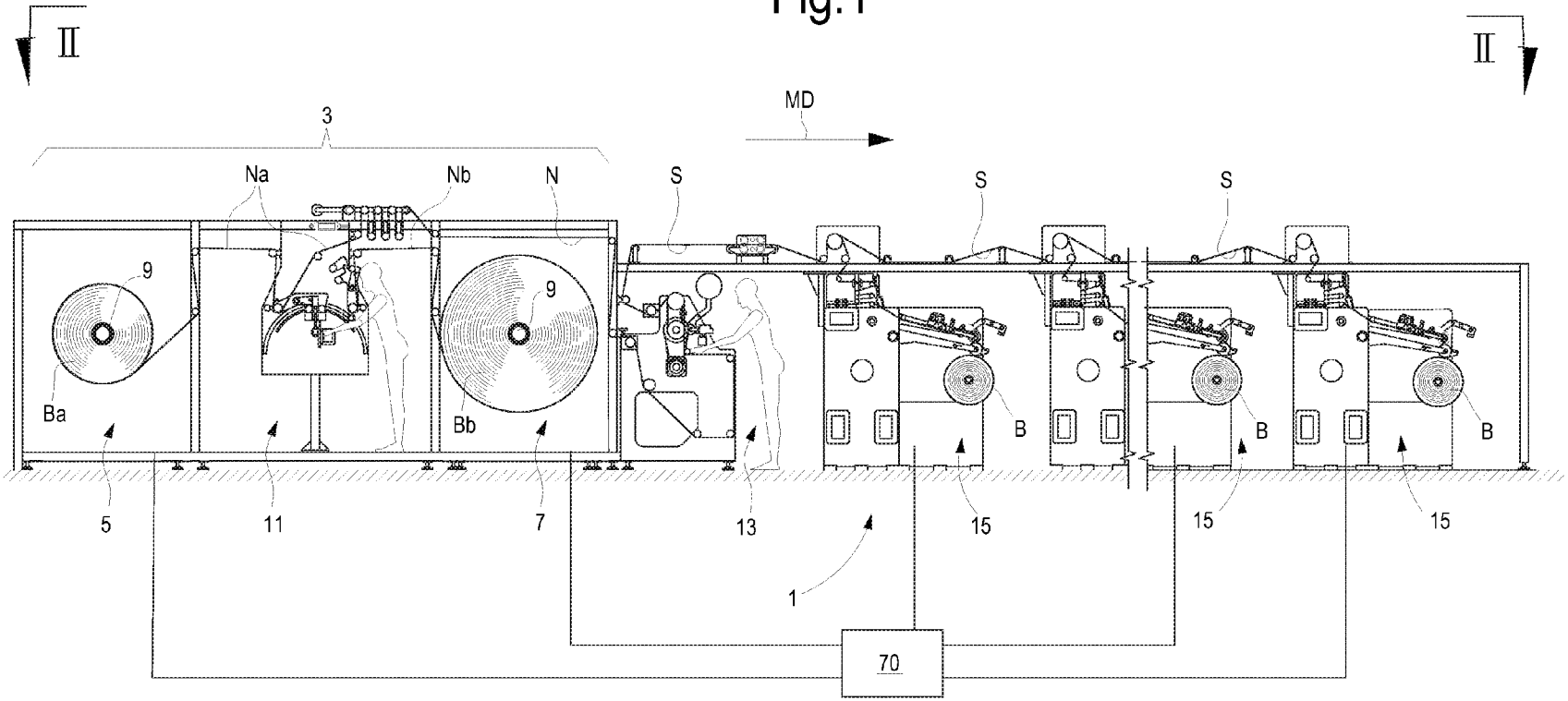
FIG. 1 shows a side view of the machine with its main stations.

FIG. 1 shows an overall side view of the machine for the production of helically wound spools. The machine is in reality a converting line inclusive of a plurality of stations. The machine is indicated as a whole by 1. It has an unwinding section 3, in which parent reels, also known as master rolls or jumbo rolls, are positioned, indicated with Ba and Bb in FIG. 1. In the embodiment illustrated, the unwinding section 3 comprises a first unwinding station 5 and a second unwinding station 7. The two unwinding stations 5 and 7 may be substantially symmetrical, and each have an unwinding mandrel, indicated with 9, on which the parent reels Ba, Bb are mounted. These latter contain a certain amount of web material, indicated with Na and Nb for the reels Ba and Bb of FIG. 1.

Between the two unwinding stations 5, 7 a cutting and welding station 11 may be arranged, wherein the tail of a web material from an exhausted parent reel positioned in one of the unwinding stations 5, 7 is welded to the leading edge of a web material on a parent reel standing-by in the other of the two unwinding stations 5, 7, to allow continuous working using a number of parent reels in sequence. The welding of web materials coming from successive parent reels takes place after slowing down or temporary stopping the unwinding of the reel that is finishing, as the machine described is of the start-stop type. In other embodiments the welding station may be located downstream of the two unwinding stations 5, 7. In yet other embodiments, more than two unwinding stations may be provided.

Figure 2:
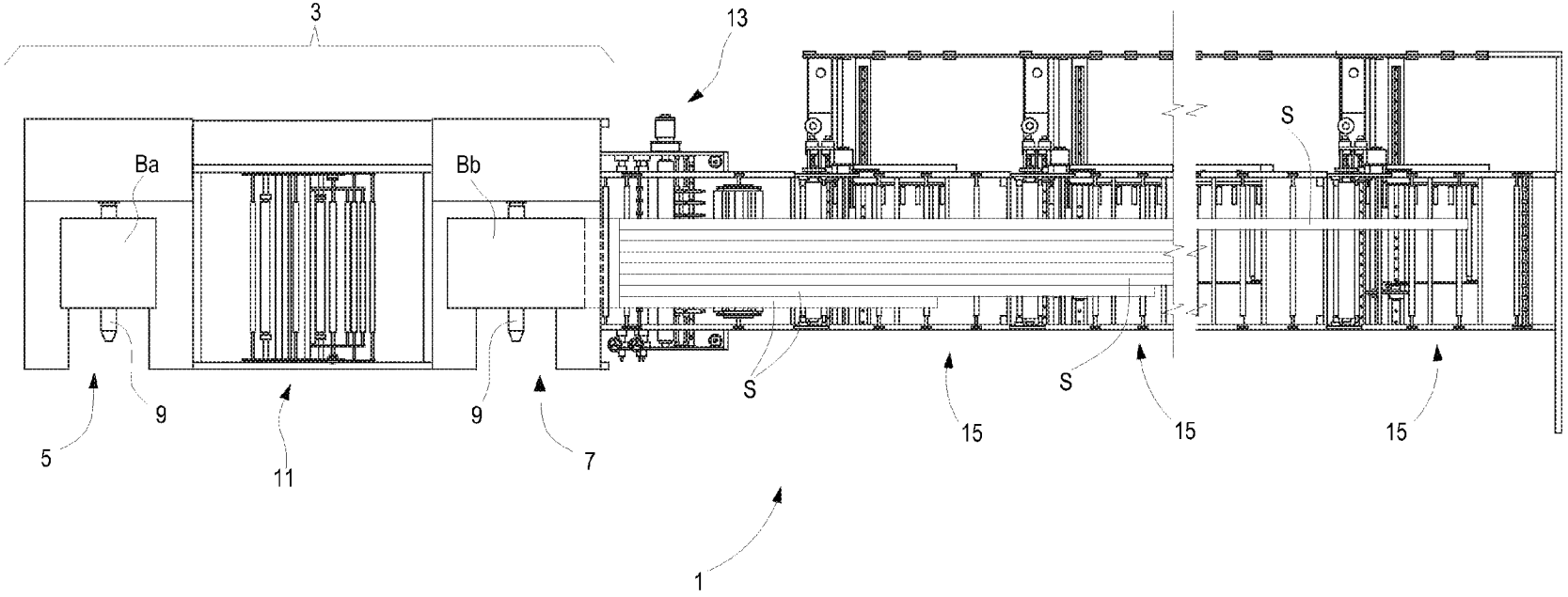
FIG. 2 shows a plan view along II-II of FIG. 1.

Downstream of the unwinding section 3 a cutting station 13 is provided, in which the web material fed by the unwinding section, generically indicated with N, is cut longitudinally and divided into a plurality of longitudinal strips S, which are fed to a plurality of helical winding stations, which can be the same as each other, each one indicated with 15. The helical winding stations 15 are arranged in sequence according to the machine direction, generically indicated by the arrow MD and represented by the direction in which the longitudinal strips S advance. For the purpose of illustration, FIGS. 1 and 2 are partial representations of just three winding stations 15, but it must be understood that the number of winding stations may vary from two to ten or more, if necessary, according to the number of longitudinal strips S into which a web material N can be divided.

Each strip S into which the web material N coming from the unwinding section 3 is divided advances along a path from the cutting station 13 to the respective winding station 15. In advantageous embodiments the feed path is located over the winding stations, but the option of arranging the feed paths under the winding stations must not be excluded.

The length of the path of each longitudinal strip S is different from the length of the paths of the remaining longitudinal strips, and depends on the position of the respective winding station 15, to which the longitudinal strip is fed.

Generically indicated with 70 is a control unit, for example a microprocessor, a micro-computer or a PLC, to control one or more of the stations making up the machine 1. In some embodiments the machine 1 may be provided with a plurality of PLCs or other dedicated local control units, for example, to supervise the operation of a part, section or station in the machine 1. The central unit 70 may be assigned to supervise and co-ordinate various local control units or local PLCs. In other embodiments a single control unit may be provided to manage the whole line or machine 1, or a plurality of the stations thereof.

Figure 3:
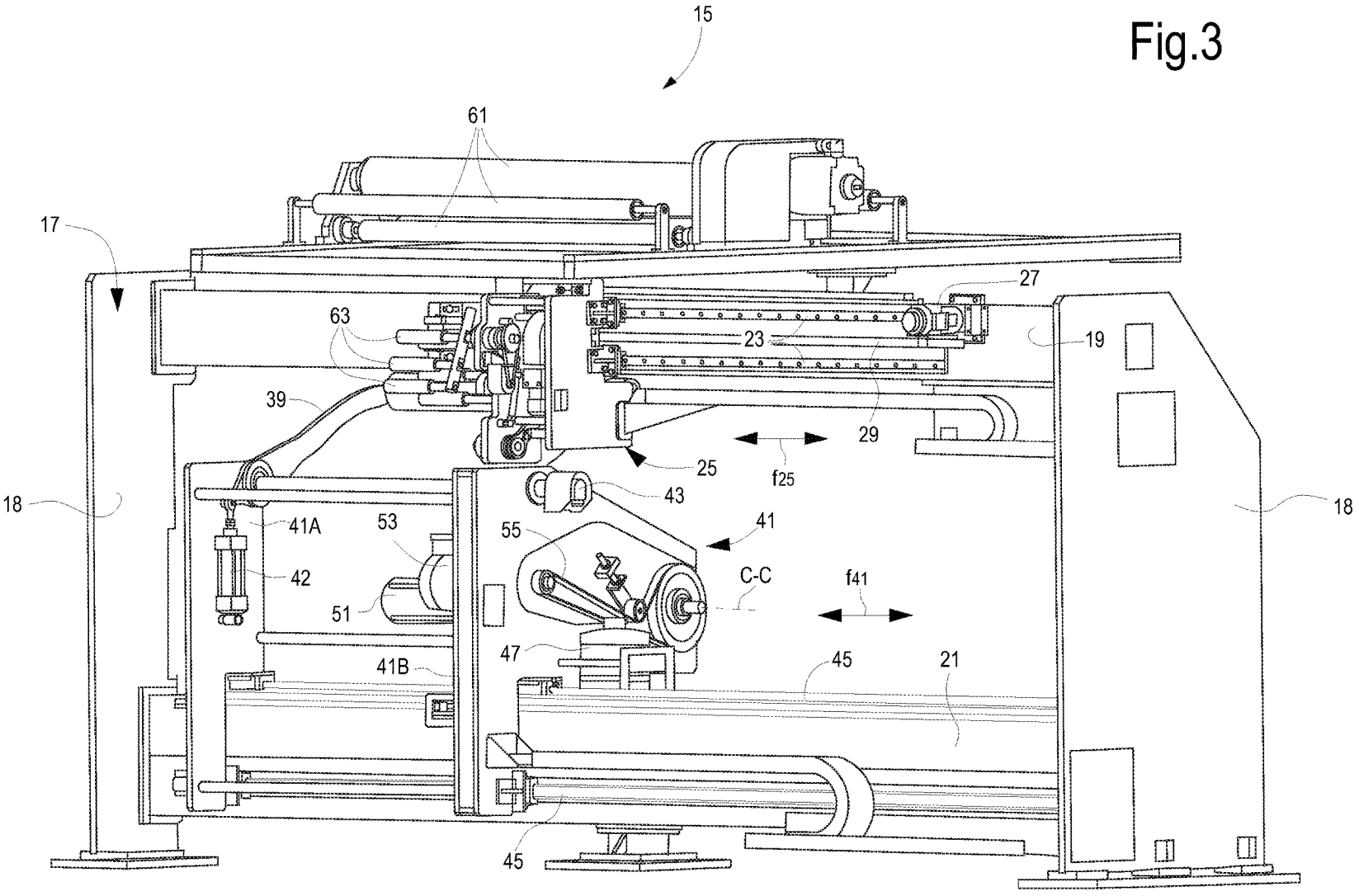
FIGS. 3 and 4 show axonometric views of a helical winding station.
Figure 4:
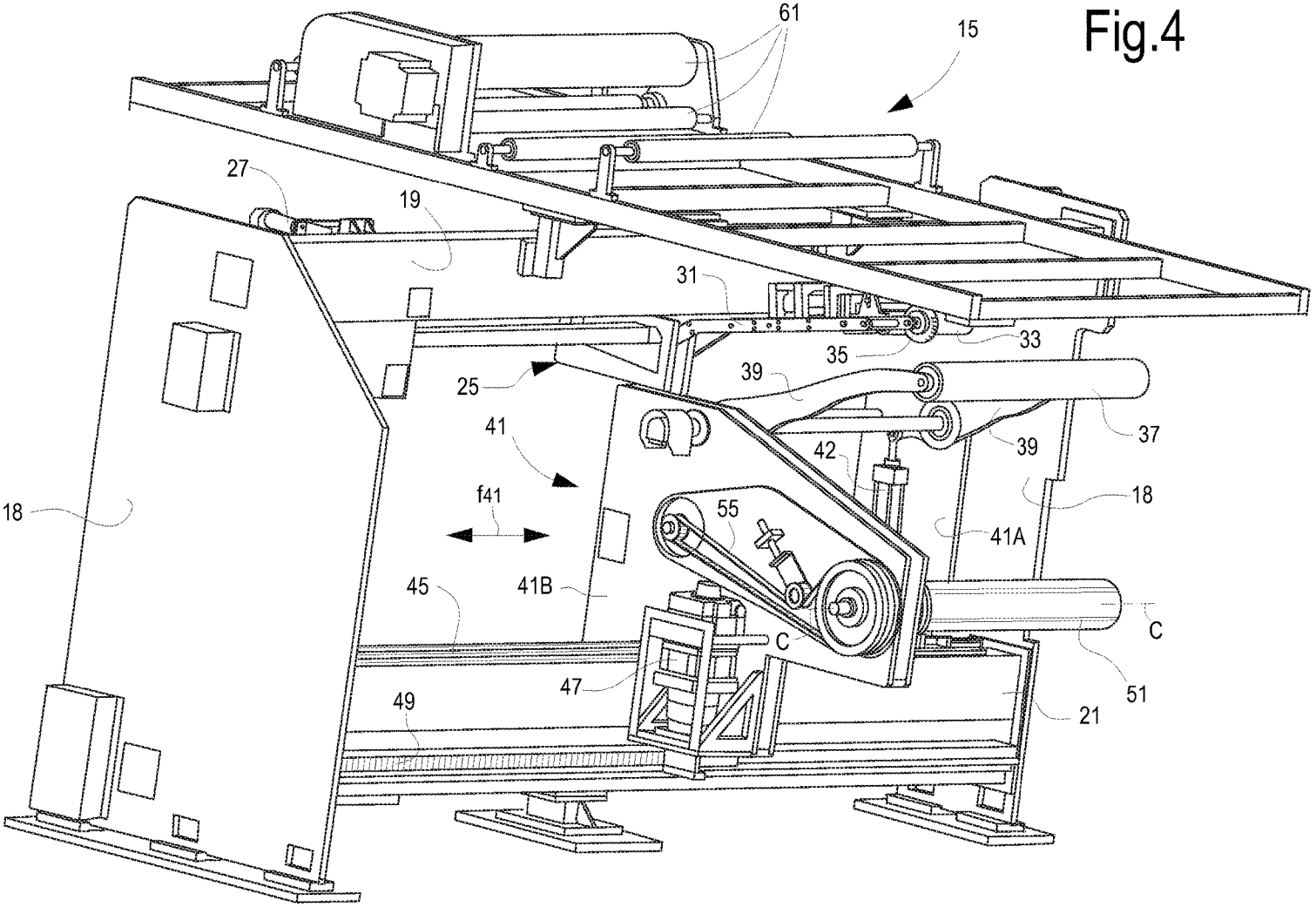
Figure 5:
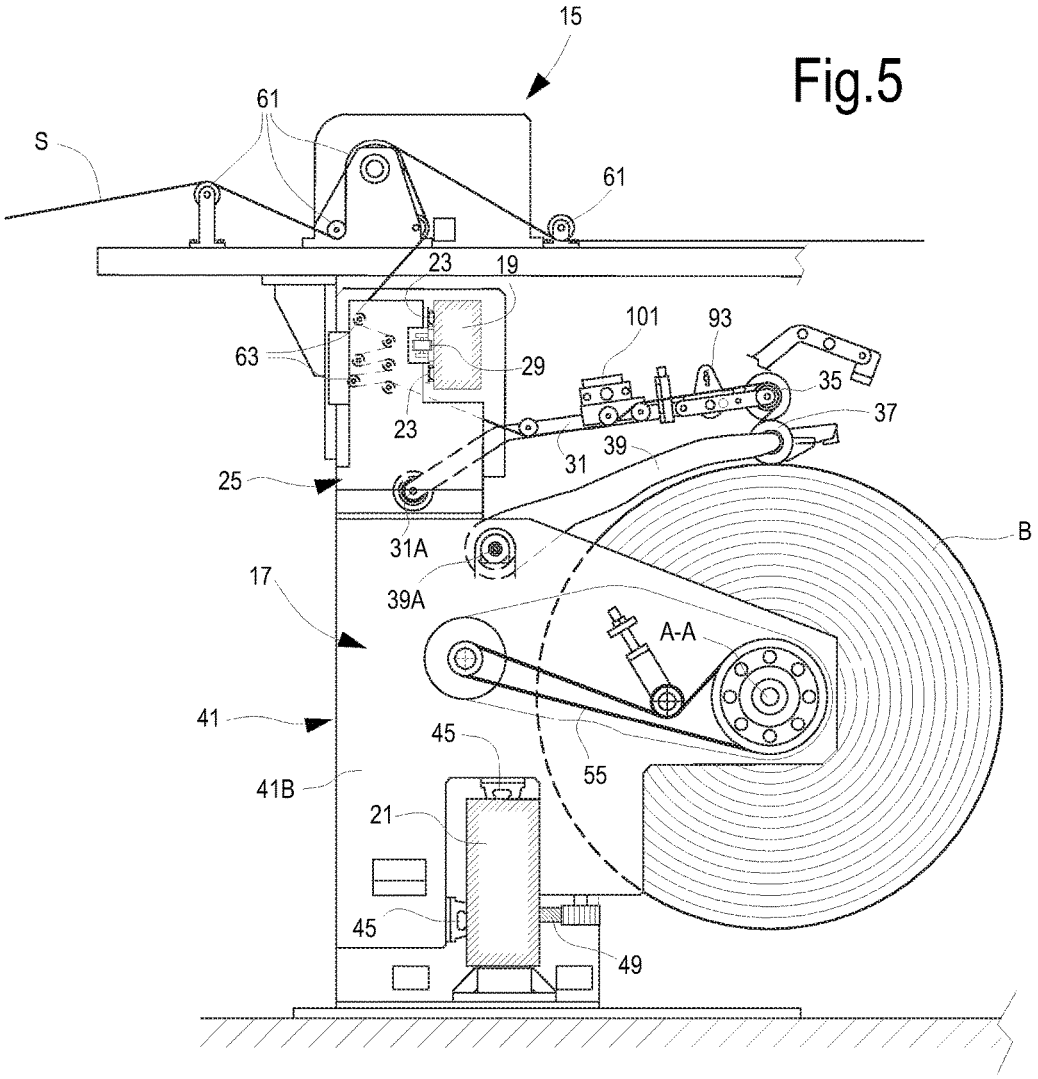
FIG. 5 shows an enlarged side view of a helical winding station.
Figure 6:
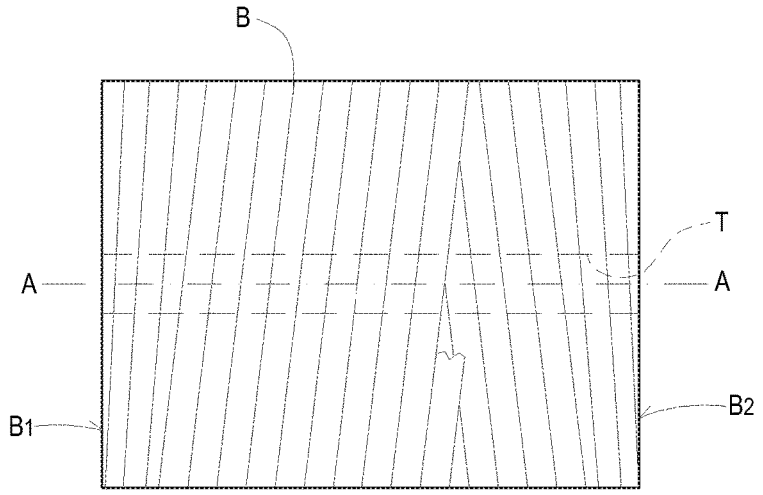
FIG. 6 shows a diagram of a helically wound spool obtained using a helical winding station according to FIGS. 3 to 5.

FIGS. 3-5 show in greater detail a possible configuration of a helical winding station 15, while FIG. 6 shows a diagram view of a helically wound spool obtained using a winding station 15. As shown in FIG. 6, the strip S that forms the helically wound spool B forms helical turns around a tubular winding core T. A-A indicates the winding axis of the helically wound spool B, and B1, B2 indicate the two axial ends of the helically wound spool B. The general structure of the helical winding station 15 is clearly shown in FIGS. 3 to 5. It comprises a bearing structure 17, which may comprise a pair of side walls 18, an upper crossbeam 19 and a lower crossbeam 21 joining the two side walls 18. On the upper crossbeam 19 first guides 23 can be provided, along which a slide 25 can move in a direction f25. Reference 27 indicates a motor that, by means of a belt 29, a threaded bar or other suitable transmission member, controls the movement of the slide 25 along the guides 23. In other embodiments, the movement may be controlled by an electric motor mounted on the slide 25, which rotates a pinion meshing with a rack constrained to the crossbeam 21.

The slide 25 carries a pivoting guide arm 31, pivoted at 31A to the slide 25 and which has the function of guiding the longitudinal strip S fed to the helical winding station 15. The guide arm 31 can support at its distal end a guide roller 33, having an axial length sufficient to receive the longitudinal strip S having the maximum width allowed by the machine 1. The guide arm 31 may be lifted and lowered by pivoting around the axis 31A. In some embodiments the guide roller 33 may be interchangeable according to the transversal size of the longitudinal strip S, for instance.

A wheel or support roller 35 can be mounted coaxially to the guide roller 33, with which the guide arm 31 rests on a contact roller 37. The contact roller 37 may be idly mounted on arms 39 hinged around a pivoting axis 39A to a carriage 41. Reference number 42 indicates a cylinder-piston actuator that can control the lifting and lowering movement of the arms 39 around the pivoting axis 39A. The arms 39 can be associated with an encoder 43 that can detect the angular position of the arms 39 with respect to the carriage 41.

The carriage 41 may comprise two side walls 41A, 41B joined together by crossbeams, bars or beams. Carriage 41 may move with a reciprocating translation motion according to the double arrow f41 along guides 45 that can be constrained to the lower beam 21. The reciprocating translation motion of carriage 41 according to the double arrow f41 can be controlled by an electric motor 47. In the embodiment illustrated the electric motor 47 is mounted on the carriage 41 and comprises a pinion in mesh with a rack 49 constrained to the beam 21. In other embodiments, other drive mechanisms can be foreseen, for example using a fixed motor and a screw or threaded bar. By coacting with a stationary rack 49, the motor 47 on board the carriage 41 allows high linear accelerations of the carriage 41 to be obtained.

A winding mandrel 51 can be mounted on the carriage 41, with a rotation axis substantially parallel to the axis of the contact roller 37 and to the pivoting axis 39A or the arms 39 that supports the contact roller 37, as well as to the reciprocating straight movement direction according to f41 of the carriage 41. The winding mandrel 51 can be driven into rotation by an electric motor 53 that can be carried by the carriage 41. For example, the winding mandrel 51 and the motor 53 can be carried by the side wall 41B of the carriage 41. A belt 55 can be provided to transmit the motion from the motor 53 to the winding mandrel 51. The rotation axis of the winding mandrel 51 is labeled C-C. This rotation axis coincides with the axis A-A of the spool B forming around the winding mandrel 51.

The structure described above allows the winding mandrel 51 to perform a double winding motion, and more specifically: a rotation movement around its own axis C-C, controlled by motor 53; and a reciprocating translation motion indicated by the double arrow f41 and controlled by motor 47. When a tubular winding core T is mounted on the winding mandrel 51, helical winding of the longitudinal strip S illustrated in FIG. 6 is achieved. During the helical winding movement the guide roller 33 may remain substantially stationary in the transversal direction, i.e. in direction f25, while it may rise gradually, together with the contact roller 37, as the diameter of the helically wound spool B increases in size. The encoder 43 may detect the angular position of the arms 39 and may therefore provide a measurement of the diameter of the helically wound spool B being formed on the winding mandrel 51.

Guide rollers for the longitudinal strips S above the winding stations 15 are indicated with 61. Tensioning rollers for the longitudinal strip S fed to each of the winding stations 15 are indicated with 63. The tensioning rollers 63 define a zig-zag path for the longitudinal strip S to form a sort of festoon. Some of the tensioning rollers 63 have a mobile axis to maintain the longitudinal strip S tensioned as required.

The machine 1 described so far operates as follows. At least one parent reel Ba or Bb is placed in at least one of the two unwinding stations 5, 7. The web material Na or Nb from the parent reel is unwound and fed through the cutting station 13, where the web material is cut into a plurality of longitudinal strips S. Each longitudinal strip S is fed to one of the helical winding stations 15 to form respective helically wound spools B. In order to be formed, each helically wound spool B usually requires the use of more than one parent reel Ba, Bb. Typically, between two and five parent reels Ba, Bb are necessary to form a series of helically wound spools B, but this number must not be considered to be limiting. As a result, when a parent reel unwinding in one of the unwinding stations 5, 7 finishes, its trailing edge is joined to the leading edge of a second parent reel that has been prepared and is waiting in the other of the two unwinding stations 5, 7. Welding takes place in the welding station 11. Welding usually takes place at low speed or with the machine stopped. Consequently, the machine 1 is slowed down or stopped when the parent reel being used has to be replaced. In other embodiments a supply of web material or longitudinal strips S can be provided, formed for example using a plurality of mobile guiding rollers. This supply may allow the winding stations 15 to continue working, if necessary at a reduced speed, even if the parent reels are stopped and no web material Na, Nb is being delivered by the unwinding station 3 for the time necessary to replace the parent reel.

When the helically wound spools B have been completed, they are removed from the winding mandrels 51 in the winding stations 15 and replaced by new tubular winding cores to start the next winding process.

The operation is usually carried out in such a way that all the helically wound spools B are completed at the same time, and can thus be replaced all together, stopping the machine 1 for the minimum amount of time possible. For that purpose the machine 1 is slowed down until it stops, that is to say until the feeding speed of the longitudinal strips S is reduced to zero.

As can be clearly seen from the above description, helical winding involves the need to use a reciprocating translation movement of the winding mandrels 51. This requires repeated accelerations and repeated stoppages of the translation movement of the slides 41 which support the winding mandrels 51.

The feeding speed of the longitudinal strips S, i.e. the linear speed at which the longitudinal strips S advance along their respective paths from the cutting station 13 to the respective winding stations 15, must be kept as high as possible to guarantee high productivity in the machine 1. Stopping cycles to replace the helically wound spools B negatively affect the productivity of machine 1 and it is advisable for these stopping cycles to be as short as possible, and for the feeding speed of the longitudinal strips S to be brought back to working speed as quickly as possible. However, particularly when the winding mandrels 51 must be made to re-start with empty tubular winding cores T or with a small amount of web material wound therearound, it is not possible to start the line up suddenly at maximum working speed. Actually, at the start of the winding the diameter of the helically wound spools being formed is small, so that a high linear feeding speed wound result in excessively frequent reversing of the reciprocal translation movement of the winding mandrel 51 with excessive acceleration and deceleration, liable to cause dynamic stress and unacceptable vibrations in the parts subject to reciprocating movement.

It is therefore necessary to perform a gradual increase in the feeding speed of the longitudinal strips S, that is to say the linear speed of the longitudinal strips S, as a function of the diameter of the helically wound spools B being formed.

Figure 7:
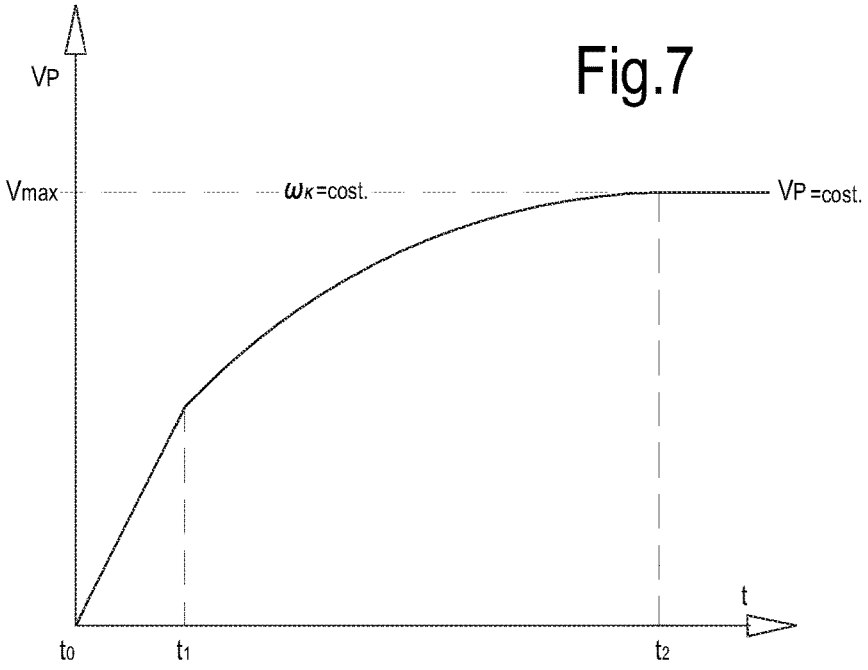
FIG. 7 shows a diagram of acceleration of the feeding of longitudinal strips to the winding stations.

FIG. 7 shows a diagram of progress over time, indicated on the X axis, of the linear speed, that is to say the feeding speed (indicated on the Y axis) of the longitudinal strips S in a possible embodiment of a method for starting the winding cycle according to the present disclosure.

The speed of advance, or feeding speed, i.e. the linear speed of the longitudinal strips S, is substantially the same for all the longitudinal strips S, and corresponds to the peripheral speed of the parent reel Ba or Bb being unwound, and to the peripheral speed of the helically wound spools B being formed in the individual winding stations 15. This linear speed is controlled by means of a control unit, for example using the control unit schematically indicated with 70 in FIG. 1. This control unit may be interfaced, either directly or indirectly, with the motors that control the advance of the web material and of the longitudinal strips S into which it is divided, as well as other members, sensors and components of the machine 1. For example, the control unit 70 can be interfaced with the motors that rotate the unwinding mandrels 9 in the unwinding section 3, as well as the motors 53 rotating the winding mandrels 51. In other embodiments it is possible to provide each section or station with its own PLC, controller or local control unit, interfaced with a main control unit, for example the control unit 70, which can work as a supervisor or master. In yet further embodiments it is possible to provide for the control units to be connected in a network, without a supervisor or master. In general, within the scope of this disclosure and of the attached claims, a control unit can be any programmable unit equipped with hardware and/or software components capable of controlling and managing one or more operations that must be carried out by the machine 1.

After stopping the winding mandrels 51, removal of the completed helically wound spools B and their replacement with empty tubular winding cores T, a cycle to accelerate the winding mandrels 51 and therefore the spools B being formed must be carried out, accelerating the longitudinal strips S from zero up to a working speed.

As can be seen in the diagram of FIG. 7, in certain embodiments the acceleration cycle for feeding of the longitudinal strips S to the winding stations 15 can be divided into three steps, a first step from time t0 to time t1, a second step from time t1 to time t2 and a third step in which the machine 1 is running in steady state conditions, which follows time t2 and can continue until the next stoppage of the machine 1. In some cases the machine may also be slowed down until reaching a reduced feeding speed, but without stopping. In this case the acceleration cycle described can be carried out partially, starting from the reduced feeding speed instead of from zero.

The following is a description of the acceleration cycle in the case of empty tubular winding cores T being found on the winding mandrels 51, that is to say the initial winding cycle is described. In other cases the cycle may also be carried out starting from partially formed spools, if these are stopped, for example, to replace the parent reel Ba or Bb.

At time t0 the parent reel Ba or Bb, which is in a delivery position, is stationary and therefore the feeding speed Vp, which corresponds to the peripheral speed of the parent reel and of the helically wound spools, is equal to zero.

In the interval [t1–t0] the control unit 70 ensures that the motors controlling the advance of the web material and the longitudinal strips start an acceleration step from zero speed up to a speed corresponding to an intermediate angular speed $\omega_k$, which is reached at time t1. This angular speed $\omega_k$ can be selected, for example, so as to maximize the linear speed Vp at which the longitudinal strips S are fed, maintaining the acceleration (positive and negative) of the reciprocating translation movement of the winding mandrels 51, and of the slides 41 that carry them, within acceptable limits, that is in a way that does not exceed admissible levels of dynamic stress on the members subject to reciprocating motion.

In a second step, which commences at time t1, the machine is made to operate by the control unit 70 in such a way as to maintain a feeding speed of the web material Na, Nb and of the longitudinal strips S, corresponding to the peripheral speed of the working spools Ba, Bb, B, as a function of the diameter of the helically wound spools B being formed.

In normal conditions all the helically wound spools B have the same diameter, i.e. they grow in diameter all in the same way. It is therefore sufficient to detect the diameter of one of those helically wound spools B in order to control this acceleration step by means of the control unit 70. Alternatively, the diameter of all the helically wound spools being formed can be detected and an average diameter can be calculated. In yet other embodiments it is possible to envisage that the spool being formed in one of the winding stations 15, for example the first one, or the last one or an intermediate station, always be selected.

In yet further embodiments it is possible to carry out instantaneous measurement of the diameter of all the helically wound spools B being formed and select, for the purposes of controlling the feeding speed Vp of the longitudinal strips B, the spool B with the smallest diameter, or the spool with the largest diameter, or the spool B with the diameter closest to the average diameter.

The diameter of the helically wound spool or spools that are used to control the acceleration ramp can be measured either directly or indirectly. In the former case it is possible to use, for example, the encoder 43 that determines the angular position of the arms 41 and therefore of the contact roller 39, or a contactless sensor, for example an optical sensor, or again a capacitive sensor or other sensor. In the latter case (indirect measurement) it is possible to use the value of the instantaneous angular speed and the instantaneous linear speed of advance of the longitudinal strips S. The diameter of the helically wound spool B is calculated using the formula $$Vp = \frac{\omega D}{2}$$

and therefore $$D = 2\frac{Vp}{\omega}$$

where Vp is the peripheral speed of the helically wound spool, corresponding to the linear speed of the longitudinal strip S of web material that is being wound around it, ω is the angular speed and D is the diameter of the spool B.

According to some embodiments, in the interval from time t1 to time t2 the control can be carried out in such a way as to maintain a constant angular speed of the helically wound spools B being formed. In this way, as the diameter D of the helically wound spools B increases gradually over time, the peripheral speed Vp, i.e. the linear feeding speed of the longitudinal strips S, also increases, until it reaches a staedy state speed Vmax at time t2. From this instant onward, the control is carried out by maintaining the linear feeding speed Vp of the longitudinal strips S constant, and thus gradually reducing the angular speed of the winding mandrels.

Figure 8:
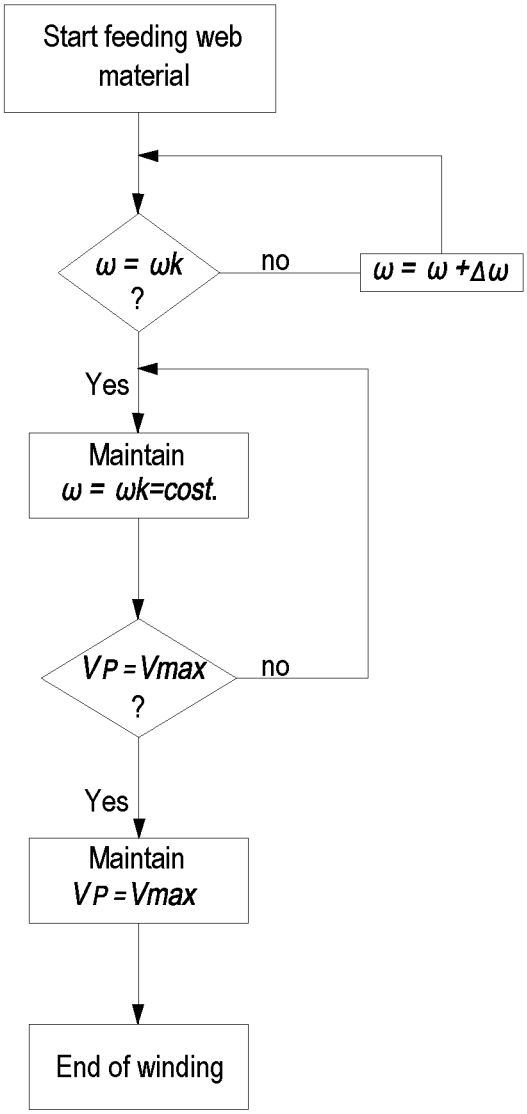
FIG. 8 shows a flow diagram of an acceleration method for the longitudinal strips.

The method described above is summarized in the block diagram of FIG. 8. Once the maximum feeding speed Vmax has been reached, the machine remains in operation at this working speed until the end of the winding operation is reached. This can occur when the desired amount of material has been wound onto the helically wound spools B, or when the parent reel Ba or Bb being processed finishes.

In the latter case the machine is slowed down and optionally stopped to replace the finished parent reel with a new parent reel. The machine is then returned to operation at the working speed, following the same process described above. However, as in this case the helically wound spools B are not empty, but start from an intermediate diameter somewhere between the starting diameter (diameter of the tubular winding core T) and the final diameter, the acceleration step from t1 to t2 at a constant angular speed will last for a shorter time. In effect, the peripheral speed Vp at time t1 (when the angular speed reaches the value $\omega_k$) will be greater than in the case described above for the start of the winding operation.

Control of the acceleration cycle thus becomes automatic, without the need for intervention by the operator and independent of other production parameters.

In the machines and methods according to the prior art the operator was obliged to change the angular acceleration conditions of the winding mandrel as a function, for example, of the weight or thickness of the web material, of the axial length of the helically wound spool B, of the inclination of the winding helix, of the width of the longitudinal strips S to be wound. On the other hand, using the method described herein no variation or modification of the acceleration mode of the winding mandrel 51 is required on start-up of the machine 1. The feeding speed is controlled as a function of the diameter of the helically wound spools B being formed, regardless of any other production parameter. This makes management of the machine 1 much simpler, reduces the burden for the operator, and reduces or eliminates the risk of errors during setting of the acceleration conditions, that might have a negative effect on the final quality of the helically wound spools.

Similar advantages can be obtained in the case of winding operations that are not helical, but spiral. In this case also the acceleration ramp becomes independent of the production parameters, such as the density, thickness or weight of the web material being wound.

The characteristic of the step (t2–t1), which consists in maintaining the angular speed ω constant, is particularly advantageous, as it makes control very simple: the angular speed remains constant while the linear speed increases as a direct consequence of the diameter increase of the helically wound spools B being formed. However, other possible methods or sequences to reach the maximum linear feeding speed Vmax, while maintaining a relation between the diameter and the feeding speed, are not to be excluded.

For example, according to other embodiments, it is possible to control the feeding speed so as to keep at a controlled value the inertial forces exerted on the reciprocating motion members (winding mandrel 51, carriage 41 and relevant components mounted thereon). The inertial force is given by F=ma, where m is the overall mass of the elements subject to acceleration and deceleration, while a is the acceleration (derivative of the speed) of the parts subject to reciprocating motion (carriage 41 with the masses connected thereto, including the spool B being formed). Assuming that the winding density is constant, the mass of the helically wound spool B being formed increases as the diameter increases. The feeding speed of the longitudinal strip S, i.e. its linear speed, is increased gradually at the same time as a slight reduction in the angular speed of the winding mandrel, so that, although the overall mass subject to reciprocating movement increases (due to the increase in the mass of the spool) the inertial force remains constant. In effect, by gradually decreasing the angular speed of the mandrel, the acceleration of the reciprocal linear movement of the carriage 41 is reduced.

In this case also, in short, the acceleration process involves a step in which the feeding speed, that is to say the linear speed of the longitudinal strip S, is a function of the diameter of the spool being formed, as it is assumed that this diameter is a parameter closely related to the mass of the helically wound spool B and therefore to the overall mass subject to reciprocating straight movement.

Although a control that keeps the inertial force constant is currently preferable, more generally, the control may be such as to obtain a given inertial force, which is not necessarily constant throughout the acceleration step. Control of the acceleration step, so as to keep the inertial force under control (using the winding diameter parameter as the parameter indicating the overall mass of the spool), makes it possible to maintain the dynamic stress, to which the reciprocatingly moving parts are subject, within set limits.

What is claimed is:

1. A machine for forming spools of web material, comprising:

an unwinding section for unwinding parent reels of web material;

at least one winding station, comprising a winding device, to which a longitudinal strip of web material is fed, and where a respective spool of web material is formed;

a control unit configured to control the winding speed of the longitudinal strip in the winding station;

wherein the control unit is configured to perform an acceleration cycle in order to accelerate the winding of the longitudinal strip, comprising at least a step of gradually increasing the feeding speed of the longitudinal strip, wherein the feeding speed is linked to the diameter of the spool; and wherein the winding device of the winding station comprises a winding mandrel provided with a rotation movement around a rotation axis and with a reciprocating translation movement in a direction parallel to the rotation axis, so as to helically wind the longitudinal strip around the winding mandrel and to form a helically wound spool.

2. Machine according to claim 1, wherein the control unit is configured such that the step of gradually increasing the feeding speed of the longitudinal strip comprises a step of winding the spool at constant angular speed.

3. Machine according to claim 2, wherein the control unit is configured such that the acceleration cycle comprises a preliminary step, preceding the step of gradually increasing the feeding speed, wherein winding is controlled by gradually increasing the angular speed of the spool in the winding station from zero to a preset angular speed.

4. Machine according to claim 3, wherein the control unit is configured such that the step of gradually increasing the feeding speed of the longitudinal strip comprises a winding step wherein the angular speed varies so as to keep the inertial force generated by the reciprocating translation motion at a controlled value, said inertial force being a function of the diameter of the spool on the winding mandrel.

5. Machine according to claim 2, wherein the control unit is configured such that the step of gradually increasing the feeding speed of the longitudinal strip comprises a winding step wherein the angular speed varies so as to keep the inertial force generated by the reciprocating translation motion at a controlled value, said inertial force being a function of the diameter of the spool on the winding mandrel.

6. Machine according to claim 2, further comprising: a cutting station, comprising cutting members to divide the web material, coming from the unwinding section, into a plurality of longitudinal strips; and a plurality of winding stations, each of which comprises a respective winding device.

7. Machine according to claim 1, wherein the control unit is configured such that the acceleration cycle comprises a preliminary step, preceding the step of gradually increasing the feeding speed, wherein winding is controlled by gradually increasing the angular speed of the spool in the winding station from zero to a preset angular speed.

8. Machine according to claim 7, wherein the control unit is configured such that the step of gradually increasing the feeding speed of the longitudinal strip comprises a winding step wherein the angular speed varies so as to keep the inertial force generated by the reciprocating translation motion at a controlled value, said inertial force being a function of the diameter of the spool on the winding mandrel.

9. Machine according to claim 1, wherein the control unit is configured such that the step of gradually increasing the feeding speed of the longitudinal strip comprises a winding step wherein the angular speed varies so as to keep the inertial force generated by the reciprocating translation motion at a controlled value, said inertial force being a function of the diameter of the spool on the winding mandrel.

10. Machine according to claim 1, further comprising: a cutting station, comprising cutting members to divide the web material, coming from the unwinding section, into a plurality of longitudinal strips; and a plurality of winding stations, each of which comprises a respective winding device.

11. Machine according to claim 1, wherein the control unit is configured such that, in steady-state conditions, the feeding speed is a substantially constant speed.

12. Machine according to claim 1, wherein the control unit interfaces with motor members of the unwinding section and with motor members of each winding station.

13. A method for winding longitudinal strips of web material on spools to be formed in a winding station, comprising the following steps:

feeding a longitudinal strip of web material to the winding station;

starting rotation of a spool to be formed in the winding station;

performing a step of accelerating the spool to be formed, wherein a feeding speed of the longitudinal strip is gradually increased as a function of the diameter of the spool to be formed in the winding station;

wherein the spool to be formed is a helically wound spool, each winding station comprising a winding mandrel provided with a rotation movement around a rotation axis and with a reciprocating translation movement in a direction parallel to the rotation axis, so as to helically wind the longitudinal strip around the winding mandrel.

14. Method according to claim 13, wherein, during the acceleration step, the spool to be formed rotates at constant angular speed and the feeding speed of the longitudinal strip increases due to the increase in the diameter of the spool to be formed.

15. Method according to claim 13, further comprising the steps of:

feeding a web material to a cutting station;

dividing the web material into a plurality of longitudinal strips of web material;

feeding each longitudinal strip to a respective winding station of a plurality of winding stations, in each of which the steps are performed of starting the rotation of, and accelerating, the spools to be formed.

16. Method according to claim 13, wherein, during the acceleration step, the winding mandrel rotates at a variable angular speed, so as to keep the inertial force generated by the reciprocating translation motion at a controlled value, said inertial force being a function of the diameter of the spool being formed on the winding mandrel.

17. Method according to claim 13, wherein said acceleration step is preceded by a starting step, wherein winding is controlled by gradually increasing the angular speed of the spool to be formed from zero to a preset angular speed.

18. Method according to claim 13, wherein, when the feeding speed has achieved a steady-state speed, winding continues by keeping the feeding speed substantially constant and by gradually reducing the angular speed of the spool to be formed as the spool diameter increases.

* * * * *